US005399111A

United States Patent [19]

Kobayashi et al.

[11] Patent Number: 5,399,111

[45] Date of Patent: Mar. 21, 1995

[54] WATERCRAFT

[75] Inventors: Noboru Kobayashi; Fumihiko Ebihara, both of Iwata, Japan

[73] Assignee: Yamaha Hatsudoki Kabushiki Kaisha, Iwata, Japan

[21] Appl. No.: 263,265

[22] Filed: Jun. 21, 1994

Related U.S. Application Data

[63] Continuation of Ser. No. 977,657, Nov. 17, 1992, abandoned.

[51] Int. Cl.[6] ..... B63B 35/73

[52] U.S. Cl. ..... 440/6; 114/270; 441/65; 441/135

[58] Field of Search ..... 114/66, 270, 315, 246, 114/253; 440/6; 441/135, 65

[56] References Cited

U.S. PATENT DOCUMENTS

| | | | |
|---|---|---|---|
| 3,257,982 | 6/1966 | Meldrum | 114/315 |
| 3,324,819 | 6/1967 | Tetyak | 441/135 |
| 4,367,689 | 1/1983 | Lukehart et al. | 114/346 |
| 4,602,589 | 7/1986 | Quinata | 114/315 |
| 4,787,870 | 11/1988 | Britton | 114/66 |
| 4,840,592 | 6/1989 | Anderson | 441/135 |

FOREIGN PATENT DOCUMENTS

| | | | |
|---|---|---|---|
| 2100827 | 7/1972 | Germany | 114/315 |
| 181797 | 8/1986 | Japan | 114/144 R |
| 71791 | 4/1987 | Japan | 114/270 |
| 221991 | 9/1987 | Japan | 114/66 |
| 219497 | 9/1988 | Japan | 114/270 |
| 3295787 | 12/1991 | Japan | 114/315 |

*Primary Examiner*—Michael S. Huppert
*Assistant Examiner*—Thomas J. Brahan
*Attorney, Agent, or Firm*—Knobbe, Martens, Olson & Bear

[57] ABSTRACT

A small water powered surface watercraft that is very compact in nature inasmuch as it has only a partial deck for accommodating the upper torso of a rider and passenger in side by side fashion. The watercraft is powered by an electric motor and battery contained within a hatch at the forward portion of the watercraft. An embodiment that employs two powering electric motors and separate controls is also disclosed.

11 Claims, 5 Drawing Sheets

WATERCRAFT

This application is a continuation of application Ser. No. 07/977,657, filed Nov. 17, 1992, now abandoned.

BACKGROUND OF THE INVENTION

This invention relates to a watercraft and more particularly to a small compact watercraft that accommodate one or two riders.

A wide variety of types of watercraft have been proposed, many of which are designed primarily for personal use either by a rider alone or a rider with only one or a few passengers. The use of such small watercraft have obvious advantages in that the size and cost of the watercraft can be small making the watercraft more portable than more conventional types of watercraft. However, even the small compact watercraft have been desired so as to accommodate the rider sitting or standing on a deck and thus the watercraft is so large that it must be transported on its own trailer pulled behind an automobile or other towing vehicle.

It is, therefore, a principal object of this invention to provide an improved small compact watercraft that need not be transported on a trailer.

It is a further object of this invention to provide an improved, compact small watercraft that can be easily transported within a conventional type of motor vehicle.

It is a further object of this invention to provide a small powered watercraft of the type that can be easily carried on land by an operator.

SUMMARY OF THE INVENTION

This invention is adapted to be embodied in a small, powered, surface type of watercraft which is comprised of a hull having a partial deck opening through the rear end thereof and sized and configured to receive only the upper portion of the body of a rider in a substantially prone position with the rider's legs extending rearwardly into the water from the deck. A propulsion device is carried by the hull for propelling the watercraft through the water and control means for the propulsion device are carried by the hull so that rider can control the propulsion device. The hull has sufficient buoyancy to permit its operation on the surface of the water with a rider having the upper portion of his torso on the deck.

DETAILED DESCRIPTION OF THE PREFERRED EMBODIMENTS OF THE INVENTION

Figure 1:
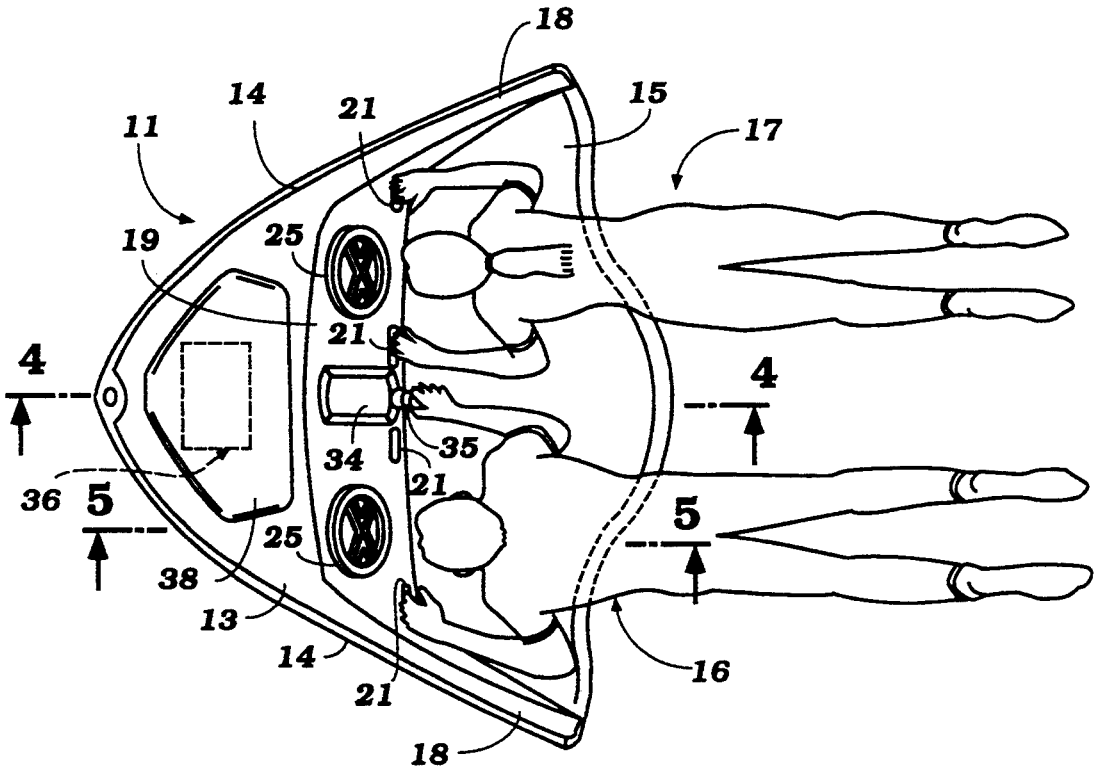
FIG. 1 is a top plan view of a small watercraft constructed in accordance with a first embodiment of the invention showing the rider and a single passenger in their riding postures.
Figure 2:
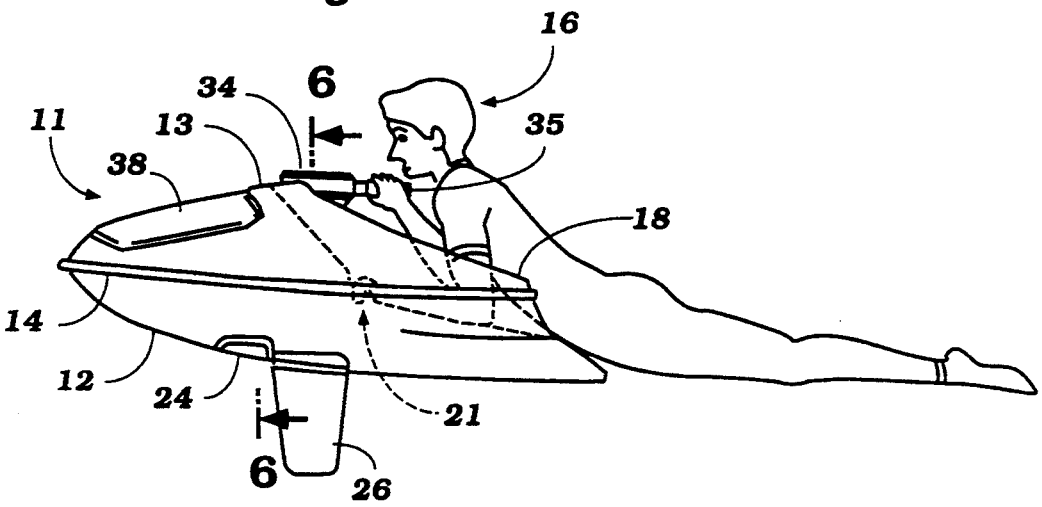
FIG. 2 is a side elevational view of the watercraft with the riders in place.
Figure 3:
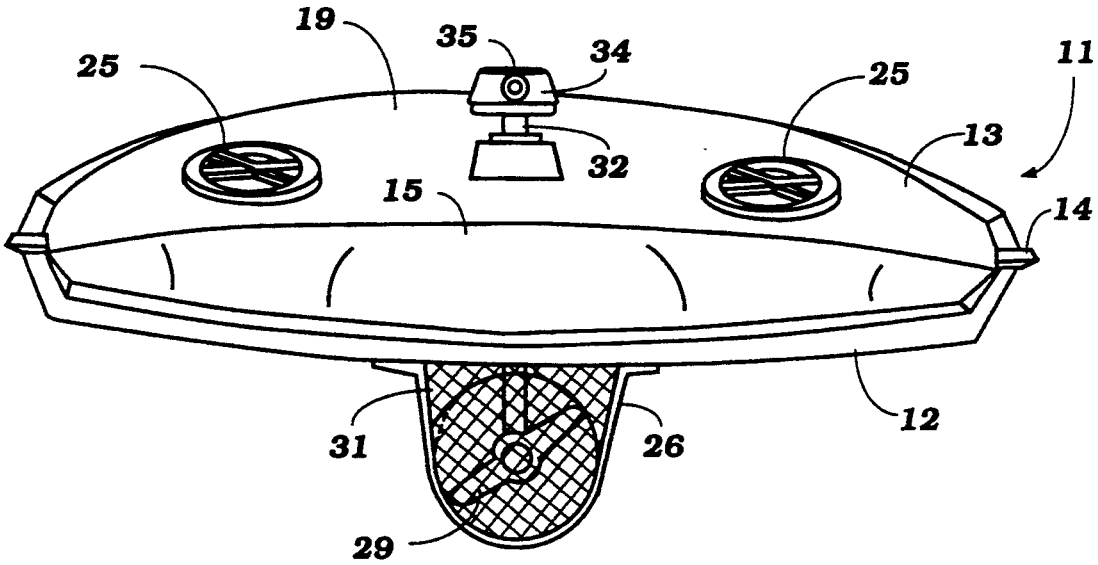
FIG. 3 is an enlarged rear elevational view of the watercraft with the riders removed.
Figure 4:
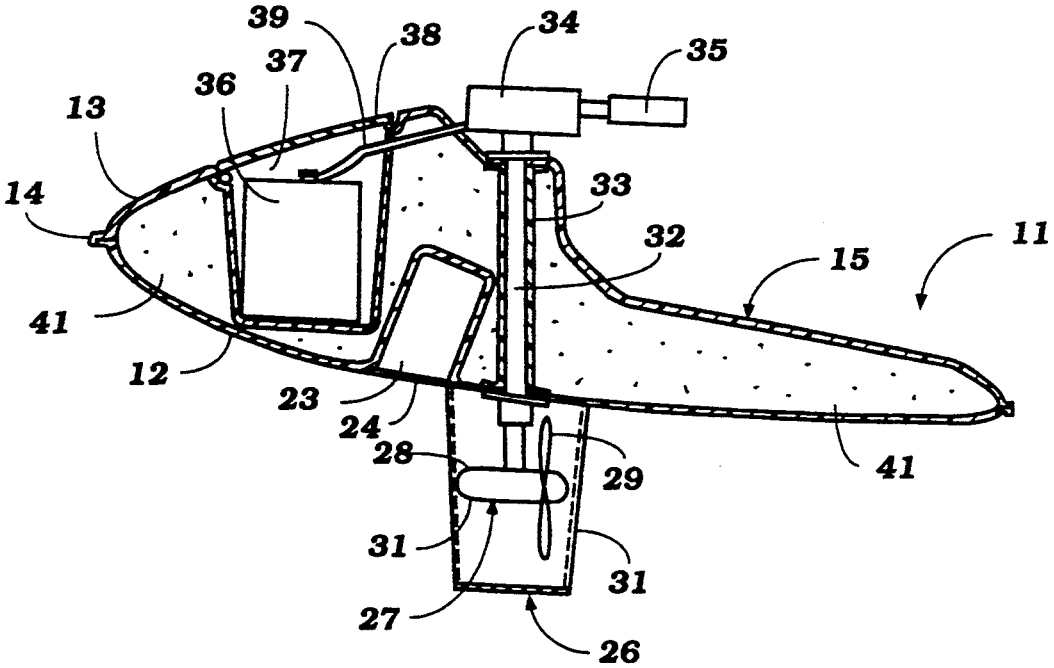
FIG. 4 is an enlarged cross sectional view taken along the line 4—4 of FIG. 1.
Figure 5:
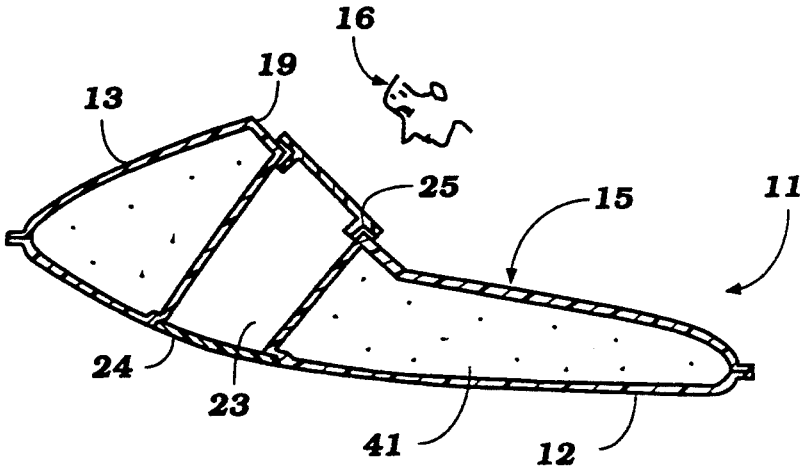
FIG. 5 is an enlarged cross sectional view taken along the line 5—5 of FIG. 1.
Figure 6:
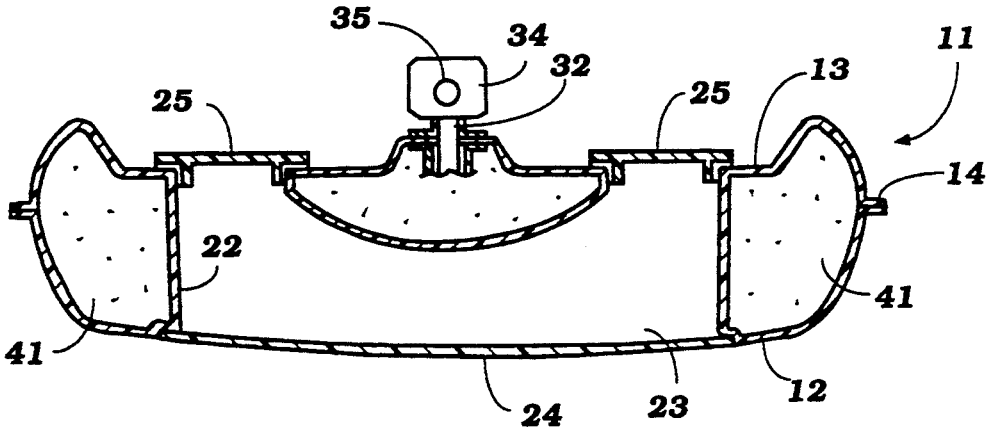
FIG. 6 is an enlarged cross sectional view taken along the line 6—6 of FIG. 2.

Referring first to the embodiment of FIGS. 1 through 6, a small watercraft constructed in accordance with this embodiment of the invention is identified generally by the reference numeral 11. As will become apparent, the watercraft 11 is designed so as to accommodate a rider and one passenger in a prone form. The manner in which this is accomplished will become apparent as the description proceeds.

The watercraft 11 is comprised of a hull which is formed from a lower hull portion 12 and an upper deck portion 13. The hull portion 12 and deck portion 13 may be formed from any suitable material such as a molded fiberglass reinforced resin or the like, except for certain parts thereof as will be described. The hull 12 and deck 13 are affixed to each other by means of bonding, sonic welding or the like with a circumferential ridge 14 being formed by the joined peripheral edges of the hull portion 12 and deck portion 13.

The deck portion 13 is formed with a deck 15 that is sized so as to accommodate a rider 16 and passenger 17 in a prone position with the upper portions of their torsos on the deck 15. The deck 15 is surrounded by an upstanding wall portion with a front wall portion and a pair of raised gunnels 18 but, at the rear, extends through the transom of the watercraft so that the rider 16 and passenger 17 may be in a prone position with the lower portions of their torsos extending into the body of water in which the watercraft is operating. The rear of the deck 15 is concavely curved in top plan with a rearwardly extending conversely curved portion disposed generally between the riders.

A panel 19 is formed forwardly of the deck 15 and is provided with handholds 21 in which the rider 16 and passenger 17 may place their hands so as to permit them to maintain themselves on the deck 15.

The deck portion 13 has a downwardly extending portion 22 that is mated with the hull portion 12 so as to define a void cavity 23. The lower portion of this void cavity 23 is closed by a transparent lower wall 24 that is affixed in any suitable manner to the hull portion 12 with a seal formed there between. Either a pair of transparent portholes 25 or removable covers are formed in the panel 19 so that the rider 16 and passenger 17 may readily view the underwater scenes which pass beneath them. In order to propel the watercraft 11 and also to assist in its stability, a skeg 26 depends from the lower hull portion 12 in an area under the panel 19. Contained with the skeg 26 is a propulsion device, indicated generally by the reference numeral 27 which is comprised on an electrical motor 28 that drives a propeller 29. The fore and aft portions of the skeg 26 are provided with screens 31 so that water may flow through the skeg under the operation of the propeller 26.

The motor 28 and propeller 29 are fixed at the lower end of a steering shaft 32 that is journaled within a sleeve 33 that extends between the deck portion 13 and hull portion 12. A control 34 is affixed to the upper end of the steering shaft 32 forwardly of the deck 15 and has a control handle 35 by which the operator may steer the electric motor and propeller 29 for steering the watercraft 11. In addition, the handlebar 35 may be rotatable so as to control a variable rheostat to control the speed of the electric motor 28, in a manner now to be described.

The electric motor 28 is powered by a battery 36 contained within a battery compartment 37 formed at the forward portion of the deck portion 13. A removable hatch 38 permits access to the battery 36 for service purposes. The battery 36 has its cables 39 extending to the control 38 wherein the rheostat may be positioned and wherein terminals further extend through the steering shaft 32 to the electric motor 28 for its power. Except for the void viewing area 23 and the battery compartment 36, the remaining void area between the deck portion 13 and hull portion 12 is filled with a floatation material. 41 such as a foam plastic which is preferably foamed in place between the hull portion 12 and deck portion 13 once they are placed together. This foamed material will also assist in securing the hull portion 12 to the deck portion 13.

Figure 7:
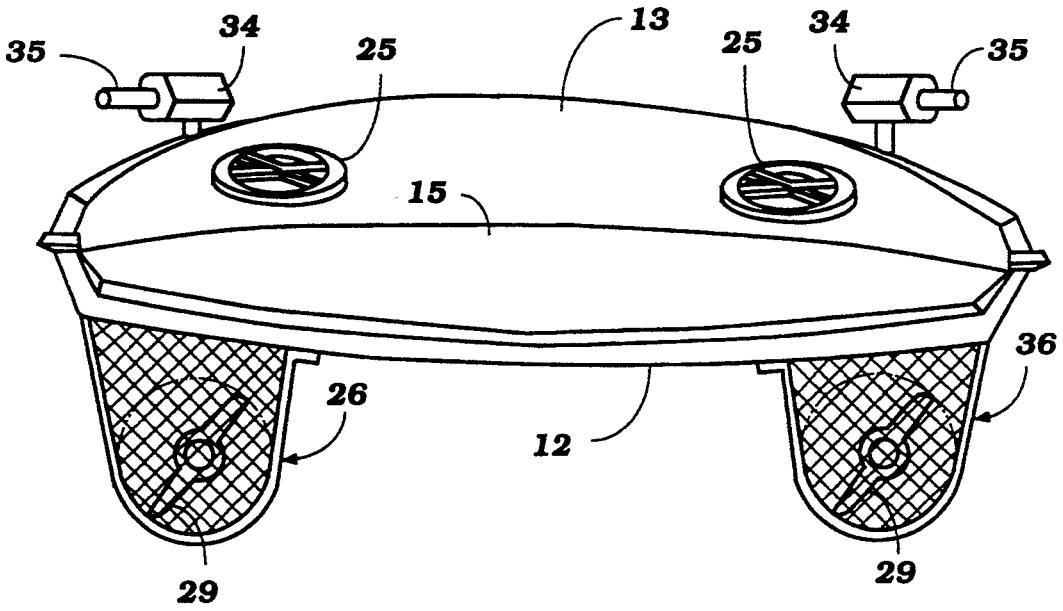
FIG. 7 is a rear elevational view, in part similar to FIG. 3, and shows another embodiment of the invention.
Figure 8:
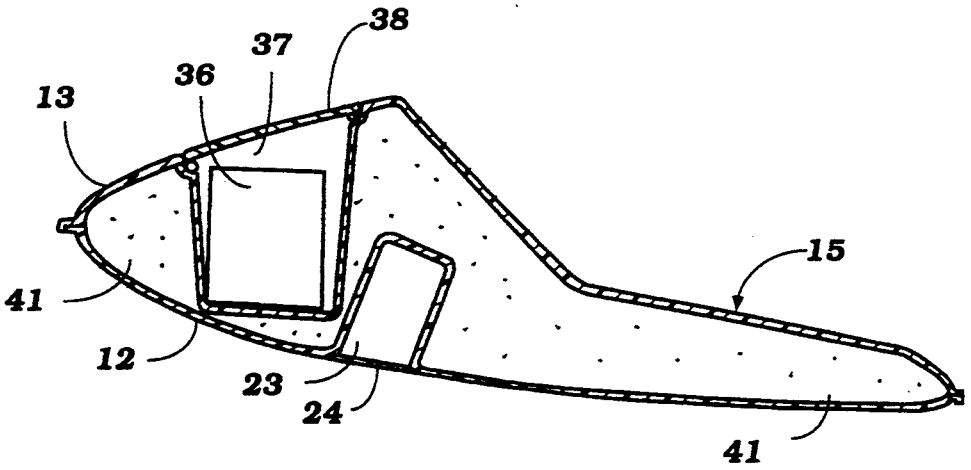
FIG. 8 is a cross sectional view, in part similar to FIG. 4 for this embodiment.
Figure 9:
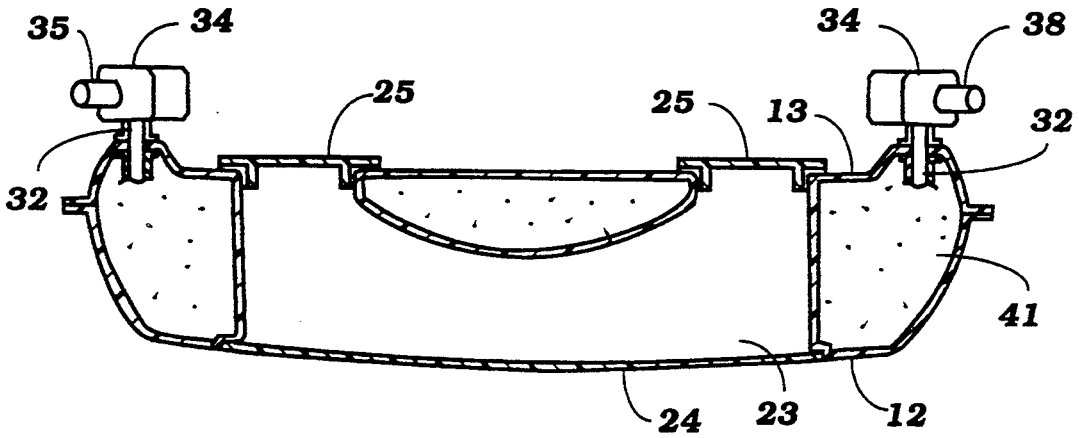
FIG. 9 is an enlarged cross sectional view, in part similar to FIG. 6 for this embodiment.

FIGS. 7 through 9 show another embodiment of the invention which is generally the same as the embodiment of FIGS. 1 through 6. For this reason, components of this embodiment which are the same as the previously described embodiment have been identified by the same reference numerals and will not be described again, except insofar as is necessary to understand the construction and operation of this embodiment.

In the embodiment of FIGS. 1 through 6, the watercraft 11 was powered by a single propulsion device 27. In this embodiment, two such propulsion devices are provided, one at each side of the watercraft. Each propulsion device has its own control 36 including a handlebar 35 by which the respective propulsion device 27 maybe steered and its power control. Both electric propulsion devices 27 may be powered either by the single battery 36 as in the preceding embodiment or by its own separate battery. Aside from these differences, this construction is the same as that previously described and, for that reason, further description is not believed to be necessary.

It should be readily apparent that the described embodiments of the invention are effective in providing a small watercraft that accommodate a rider and one passenger and yet is small enough to be easily carried in an automobile either in the trunk or overhead without requiring a specific trailer for it. In addition, the watercraft is small enough to be easily manipulated when on land either by the rider or the rider and passenger. Of course, the foregoing description is that of preferred embodiments of the invention and various changes and modifications may be made without departing from the spirit and scope of the invention, as defined by the appended claims.

We claim:

1. A small powered surface watercraft comprised of a hull having only a lower hull portion and a coextensive upper deck portion devoid of outriggers and defining a partial deck opening through the rear end thereof and sized and configured to receive only the upper portion of the bodies of a pair of riders in a substantially prone side by side position with the riders legs extending rearwardly into the water from said deck, said partial deck being comprised of a generally horizontally extending portion defined at its front and sides by an upstanding wall portion with the front of said wall being the highest portion and the sides thereof tapering downwardly in height, the rear of said horizontal extending portion being concavely curved in top plan from said sides to a rearwardly extending conversely curved portion disposed generally between the riders, said hull providing the entire buoyancy for the riders, a propulsion device carried by said hull beneath said deck area for propelling said hull through the water, and control means carried by the upstanding wall portion of said hull for controlling said propulsion device by at least one of said riders, said hull having sufficient buoyancy to permit operation on the surface of the water with the riders positioned at least partially on said deck.

2. A small powered surface watercraft as set forth in claim 1 wherein there are a pair of propulsion devices each controlled by a respective control means positioned at one side of and forwardly of the deck.

3. A small powered surface watercraft as set forth in claim 2 wherein each propulsion device comprises an electric motor.

4. A small powered surface watercraft as set forth in claim 3 further including a battery carried by the hull for powering the electric motors.

5. A small powered surface watercraft as set forth in claim 4 wherein each electric motor .drives a propeller and is supported for steering movement by the control means about a generally vertically extending steering axis.

6. A small powered surface watercraft as set forth in claim 1 wherein an area forwardly of the deck is formed with a porthole that permits a rider to look downwardly through the hull into the body of water in which the watercraft is operating.

7. A small powered surface watercraft as set forth in claim 6 wherein the porthole is provided with a removable cover.

8. A small powered surface watercraft set forth in claim 6 wherein there provided a pair of portholes one at each side of the deck for use by each rider.

9. A small powered surface watercraft as set forth in claim 8 wherein there are a pair of propulsion devices each controlled by a respective control means positioned at one side of and forwardly of the deck.

10. A small powered surface watercraft as set forth in claim 6 wherein the porthole opens into a void area formed within the hull with a transparent lower wall covering the void area.

11. The small powered surface watercraft as set forth in claim 1, wherein there are a pair of propulsion devices carried by the hull beneath the deck area and operated by the control means.

* * * * *